US009277317B2

(12) United States Patent
Norris

(10) Patent No.: US 9,277,317 B2
(45) Date of Patent: Mar. 1, 2016

(54) TUNABLE INDUCTIVE DEVICE FOR PARAMETRIC AUDIO SYSTEMS AND RELATED METHODS

(71) Applicant: Parametric Sound Corporation, Poway, CA (US)

(72) Inventor: Elwood Grant Norris, Poway, CA (US)

(73) Assignee: Turtle Beach Corporation, San Diego, CA (US)

( * ) Notice: Subject to any disclaimer, the term of this patent is extended or adjusted under 35 U.S.C. 154(b) by 172 days.

(21) Appl. No.: 14/035,789

(22) Filed: Sep. 24, 2013

(65) Prior Publication Data

US 2015/0086040 A1 Mar. 26, 2015

(51) Int. Cl.

| | |
|---|---|
| ***H04R 3/00*** | (2006.01) |
| ***H04R 3/02*** | (2006.01) |
| ***H01F 27/42*** | (2006.01) |
| ***H01F 27/02*** | (2006.01) |
| ***H01F 17/04*** | (2006.01) |
| ***H04R 23/00*** | (2006.01) |

(52) U.S. Cl.

CPC ..... *H04R 3/02* (2013.01); *H01F 17/043* (2013.01); *H01F 27/02* (2013.01); *H01F 27/42* (2013.01); *H04R 23/00* (2013.01)

(58) Field of Classification Search

CPC ..... H04R 2217/03; H04R 3/00; H04R 27/00
USPC ..... 381/77, 94.1, 117, 111
See application file for complete search history.

(56) References Cited

U.S. PATENT DOCUMENTS

| | | | | |
|---|---|---|---|---|
| 3,609,615 | A | 9/1971 | Parker et al. | |
| 4,591,819 | A | 5/1986 | Nero | |
| 6,914,991 | B1 | 7/2005 | Pompei | |
| 8,157,048 | B2 * | 4/2012 | Banter et al. | 181/198 |
| 8,391,514 | B2 * | 3/2013 | Norris | 381/111 |
| 2004/0032315 | A1 * | 2/2004 | Illingworth | 336/212 |
| 2012/0147707 | A1 * | 6/2012 | Norris | 367/137 |

FOREIGN PATENT DOCUMENTS

| | | |
|---|---|---|
| EP | 2521144 | 11/2012 |

OTHER PUBLICATIONS

International Search Report and the Written Opinion for International App No. PCT/US2014/057270, mailed Jan. 16, 2015, Authorized Officer: Wagner, Judit.

* cited by examiner

*Primary Examiner* — Disler Paul
(74) *Attorney, Agent, or Firm* — Sheppard Mullin Richter & Hampton LLP

(57) ABSTRACT

An apparatus and method for optimizing a parametric emitter system having a pot core inductive device coupled between an amplifier and emitter. The pot core inductive device allows for adjustments of the air gap formed between the two halves of the pot core structure to adjust its inductive value. This post-manufacture adjustability allows for corrections of differences caused by operations of other components in the audio system and to account for slight differences in the electrical circuit of different amplifier/emitter combinations. As efficiency of the system is dependent on the functional relationship between the amplifier, inductive device, and emitter, this allows for fine tuning of the signal to obtain high quality.

16 Claims, 10 Drawing Sheets

TUNABLE INDUCTIVE DEVICE FOR PARAMETRIC AUDIO SYSTEMS AND RELATED METHODS

TECHNICAL FIELD

The present disclosure relates generally to parametric audio systems. More particularly, some embodiments relate to inductive devices employed with ultrasonic emitters.

DESCRIPTION OF THE RELATED ART

Non-linear transduction results from the introduction of sufficiently intense, audio modulated ultrasonic signals into an air column. Self-demodulation, or down-conversion, occurs along the air column resulting in the production of an audible acoustic signal. This process occurs because of the known physical principle that when two sound waves with different frequencies are radiated simultaneously in the same medium, a modulated waveform including the sum and difference of the two frequencies is produced by the non-linear (parametric) interaction of the two sound waves. Parametric audio reproduction systems produce sound through the heterodyning of two acoustic signals in a non-linear process that occurs in a medium such as air. The acoustic signals are typically in the ultrasound frequency range. The non-linearity of the medium results in acoustic signals produced by the medium that are the sum and difference of the acoustic signals. Thus, two ultrasound signals that are separated in frequency can result in a difference tone that is within the 60 hz to 20,000 Hz range of human hearing.

While the theory of non-linear transduction has been addressed in numerous publications, commercial attempts to capitalize on this intriguing phenomenon have largely failed. Most of the basic concepts integral to such technology, while relatively easy to implement and demonstrate in laboratory conditions, do not lend themselves to applications where relatively high volume outputs are necessary. As the technologies characteristic of the prior art have been applied to commercial or industrial applications requiring high volume levels, distortion of the parametrically produced sound output has resulted in inadequate systems. Whether the emitter is a piezoelectric emitter or PVDF film or electrostatic emitter, in order to achieve volume levels of useful magnitude, conventional systems often required that the emitter be driven at intense levels. These intense levels have often been greater than the physical limitation of the emitter device, resulting in high levels of distortion or high rates of emitter failure, or both, without achieving the magnitude required for many commercial applications.

Efforts to address these problems include such techniques as square rooting the audio signal, utilization of Single Side Band ("SSB") amplitude modulation at low volume levels with a transition to Double Side Band ("DSB") amplitude modulation at higher volumes, and recursive error correction techniques. While each of these techniques has proven to have some merit, they have not separately, nor in combination, allowed for the creation of a parametric emitter system with high quality, low distortion, and high output volume. The present inventor has found, in fact, that under certain conditions some of the techniques described above actually cause more measured distortion than does a refined system of like components without the presence of these prior art techniques.

SUMMARY

Embodiments of the technology described herein include a pot core inductive device for use in ultrasonic audio systems.

Although the embodiments are discussed in regards to ultrasonic audio systems, the embodiments are applicable for use in any system requiring an inductive device; particularly systems where electrical resonance is important for optimal performance. In various embodiments, the device includes a non-conductive or ferromagnetic housing composed of an iron or ferrite material and comprising two sections, a coil support member, a coil structure, and an elastomeric material. The two sections of the housing are configured to define a cavity within the housing. The coil support member and elastomeric material are disposed within the cavity. The device also comprises an adjustment mechanism configured to adjust an air gap, formed between the two sections of the housing, to achieve an optimal or near optimal inductive value. An adjustable means for securing the two halves may also be present.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom," or "side" of an apparatus, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS

The present disclosure represents an improvement on a transducer system for use in ultrasonic audio production described in U.S. Pat. No. 8,391,514, issued Mar. 5, 2013 to the present inventor, which is herein incorporated by reference. Transducers convert a signal from one form of energy to another. In ultrasonic audio production, an audio system comprises an amplifier, processor circuitry, an inductive device, and an emitter coupled in an electrical circuit to convert an electrical signal into an acoustic signal, or sound. As discussed above, the present inventor discovered that many of the conventional methods for increasing the output of an ultrasonic emitter created greater distortion in the resultant audio signal. This distortion makes creation of a high quality parametric audio system difficult.

The present inventor discovered that by redesigning the transformer, electrical resonance could be achieved between an inductive device and an emitter, increasing the accuracy of the match between the electronic circuits and the emitters, thus eliminating much of the distortion resulting from physical limitations of conventional transducer devices. In one embodiment of the invention of U.S. Pat. No. 8,391,514, the invention utilized an inductive device housed within a pot core structure. Use of a pot core allowed for the inductive device to be physically located closer to the emitter, allowing the system to operate at a more efficient level by reducing the interference of the magnetic field of the inductive device with the emitter. At the same time, physically locating the inductive device closer to the emitter reduced the need for long runs of high voltage wiring to couple the inductive device to the emitter.

Although the patented design allowed for the production of a higher quality ultrasonic audio signal, the conventional design of a pot core structure limited the ability to fine-tune the resonant circuit for optimal audio output. The improvements described herein can be configured to provide a more responsive transducer to achieve the optimal output audio signal.

Figure 1:
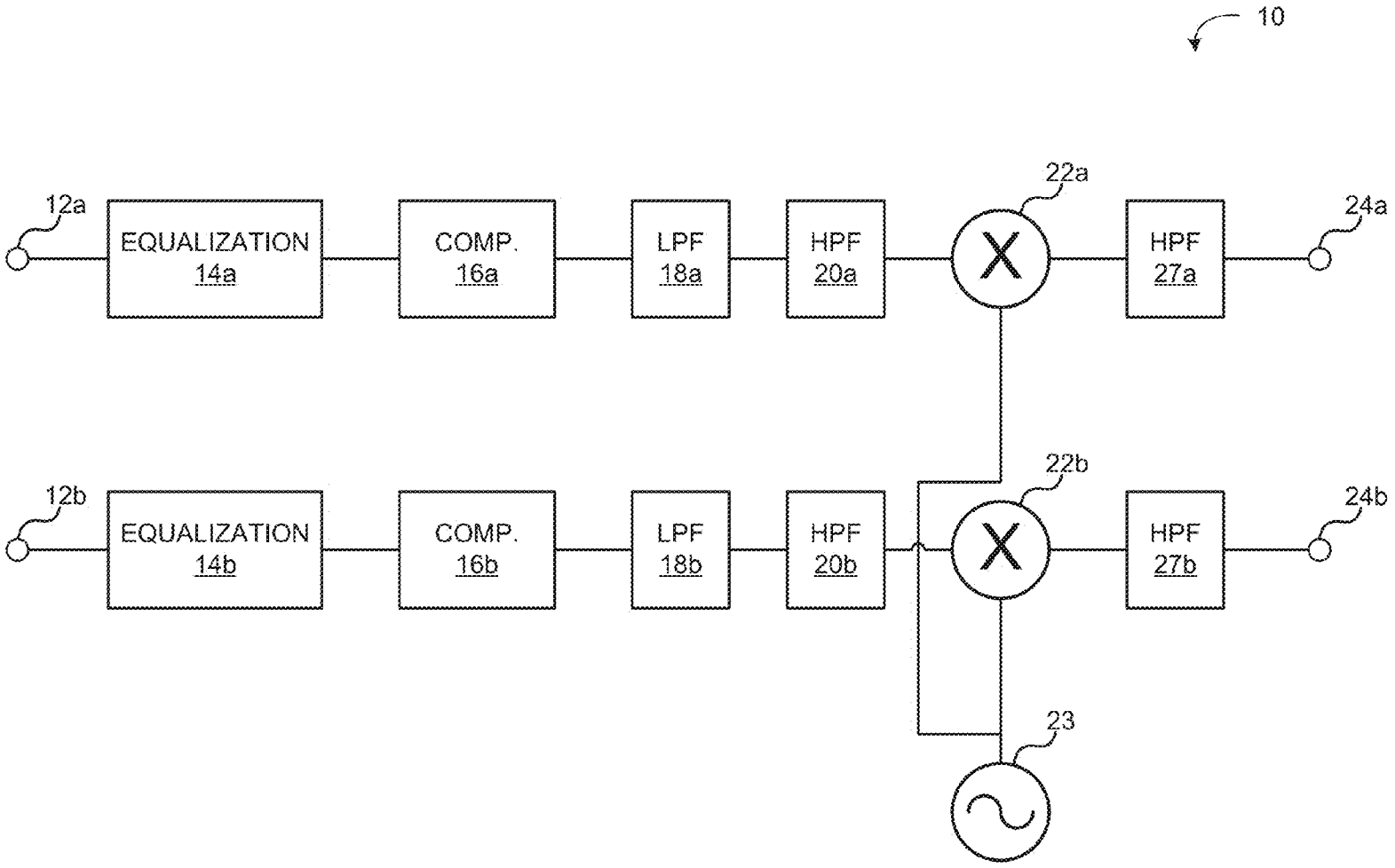
FIG. 1 is a diagram illustrating an ultrasonic sound system suitable for use with the inductive device described herein.

FIG. 1 illustrates a non-limiting signal processing system 10 that may be used with an embodiment of the invention. In this embodiment, various processing circuits or components are illustrated in the order (relative to the processing path of the signal) in which they are arranged according to one implementation. It is to be understood that the components of the processing circuit can vary, as can the order in which the input signal is processed by each circuit or component. The processing 10 can include more or fewer components or circuits than those shown.

A stereo audio signal enters the signal processing system 10 through audio inputs 12*a*, 12*b*. The source of the audio signal may be a microphone, memory, a data storage device, streaming media source, CD, DVD or other audio source. The audio content may be decoded and converted from digital to analog form, depending on the source. Equalizing networks 14*a*, 14*b* provide equalization of the signal. The equalization networks can, for example, boost or suppress predetermined frequencies or frequency ranges to increase the benefit provided naturally by the emitter/inductor combination of a transducer device.

Compressor circuits 16*a*, 16*b* compress the dynamic range of the incoming signal, effectively raising the amplitude of certain portions of the incoming signals and lowering the amplitude of certain other portions of the incoming signals. More particularly, compressor circuits 16*a*, 16*b* can be included to narrow the range of audio amplitudes. In one aspect, the compressors lessen the peak-to-peak amplitude of the input signals by a ratio of not less than about 2:1. Adjusting the input signals to a narrower range of amplitude can be done to minimize distortion, which is characteristic of the limited dynamic range of this class of modulation systems. The order of the compression and equalization circuits can be reversed.

Low pass filter circuits 18*a*, 18*b* can be included to provide a cutoff of high portions of the signal. High pass filter circuits 20*a*, 20*b* can provide a cutoff of low portions of the audio signals. The high pass filters 20*a*, 20*b* can be configured to eliminate low frequencies that, after modulation, would result in deviation of carrier frequency (e.g., those portions of the modulated signal that are closest to the carrier frequency). Also, some low frequencies are difficult for the system to reproduce efficiently and, as a result, much energy can be wasted trying to reproduce these frequencies. The low pass filters 18*a*, 18*b* can be configured to eliminate higher frequencies that, after modulation, could result in the creation of an audible beat signal with the carrier.

After passing through the low pass and high pass filter circuits, modulators 22*a*, 22*b* modulate the audio signals with a carrier signal generated by oscillator 23. Use of a single oscillator to drive both modulators 22*a*, 22*b* allows an identical carrier frequency to be used for multiple channels, lessening the risk that any audible beat frequencies may occur. High pass filters 27*a*, 27*b* can be used to pass the modulated ultrasonic carrier signal to filter out remaining unwanted signals below a certain frequency. The resultant signal then reaches the amplifier through signal processing system outputs 24*a*, 24*b*.

Figure 2:
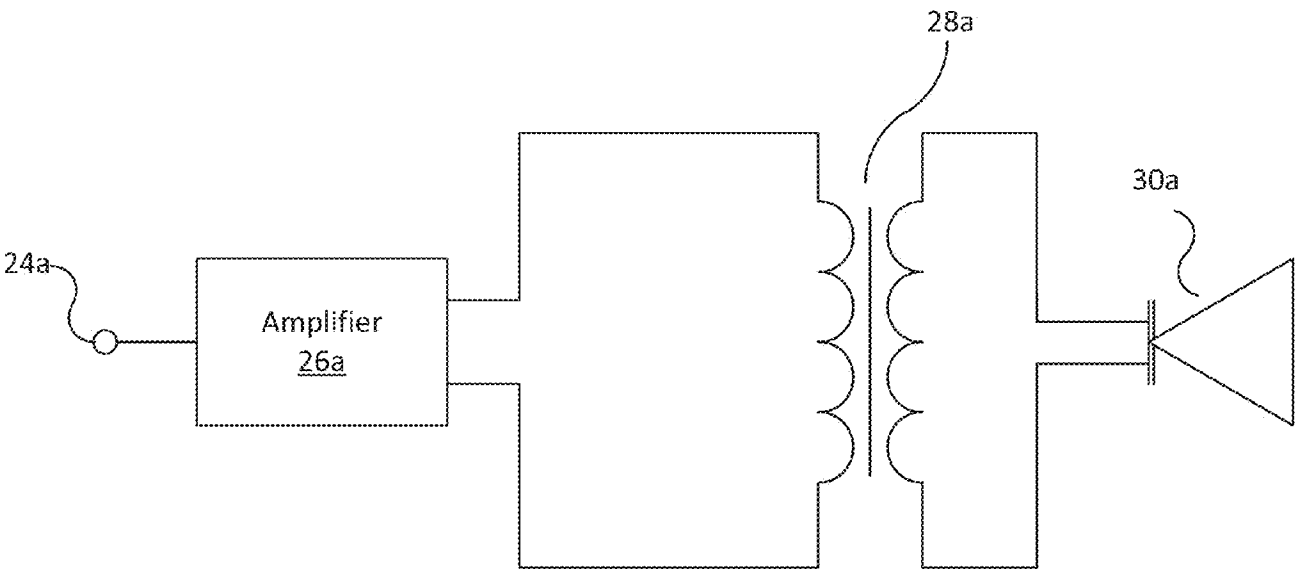
FIG. 2 is a diagram illustrating an amplifier and emitter system utilizing a pot core inductive device in accordance with an embodiment of the technology disclosed herein.

FIG. 2 is a diagram illustrating an amplifier and emitter system utilizing a pot core inductive device in accordance with an embodiment of the technology disclosed herein. Referring now to FIG. 2, the diagram illustrates an amplifier 26*a*, a pot core inductor 28*a* (configured as a transformer in this example), and an ultrasonic emitter 3*a* four one channel of the audio system. Many conventional systems utilize a transducer system with an inductive device oriented in series with the emitter. The disadvantage to this arrangement is that such a resonant circuit must necessarily cause wasted current to flow through the inductor. The emitter 30*a* will perform best at—or near—the point where electrical resonance is achieved in the circuit. The amplifier (e.g., amplifier 26*a* in FIG. 2), however, introduces changes in the circuit, which can vary based on factors including temperature, signal variance, and system performance. These effects make it more difficult to achieve and maintain stable resonance in the circuit when an inductor is coupled in series with the emitter 30*a* (FIG. 2).

A variety of inductive devices are known to those having ordinary skill in the art. Physical limitations of inductive devices, however, cause difficulties in a conventional parametric system. Inductive devices generate magnetic fields, which may "leak" beyond the confines of the inductor. Accordingly, they may interfere with the operation and response of a parametric emitter if positioned in proximity thereto.

For at least these reasons, most conventional parametric systems physically locate the inductive device a considerable distance from the emitter. This distance between the inductive device and the emitter requires longer wires for connecting the inductive device and emitter. A significant complication resulting from this physical limitation arises from the fact that a high voltage is generally required to carry the signal from the inductive device to the emitter. In certain installations, long "runs" of high voltage wiring may be necessary, which can be dangerous and interfere with communication systems not related to the transducer.

The relationship between the amplifier and the emitter adds an additional obstacle to designing an optimized and efficient transducer. Generally, the higher a frequency that is processed by an amplifier, the higher impedance at which the amplifier is best suited to operate. In the present case, the impedance experienced by the amplifier is the result of the load introduced by the inductive device and emitter pair, and by the overall transducer. In the case of parametric sound production, the operative signal is generally in the range of 40 kHz or greater. Amplifiers working with frequencies in this range generally operate more optimally when experiencing load impedances on the order of 8-12 Ohms.

To account for this, it would be desirable to match the resonance of the inductive device and emitter pair to improve the performance of the system. Limited available parametric emitter designs, however, hinder the ability to adjust the load presented by the inductive device and emitter pair. This, in turn, hinders the ability to obtain optimum resonance between the inductive device/emitter pair without adversely affecting performance of the unit as a whole.

The present inventor discovered and invented several amplifier and emitter systems utilizing an inductive device coupled in parallel with the emitter. Exemplary systems are described in detail in U.S. Pat. No. 8,391,514, which is incorporated herein by reference in its entirety. By configuring the inductive device in parallel with the emitter, the current circulates through the inductive device and emitter, as represented by circulating current path 40 in FIG. 2. Such a configuration results in more stable and predictable performance of the emitter, and significantly less power being wasted as compared to conventional series resonant circuits.

Use of a "pot core" to house the inductive device further alleviates the need for the inductive device to be physically located a distance from the emitter. It is possible to capitalize on the characteristics of a pot core structure to create achieve electrical resonance in the inductive device/emitter circuit, while simultaneously achieving sufficient impedance for optimal operation of the amplifier. Although not optimal, use of a pot core inductive device in accordance with the present invention may also be coupled in series with the emitter.

Figure 5:
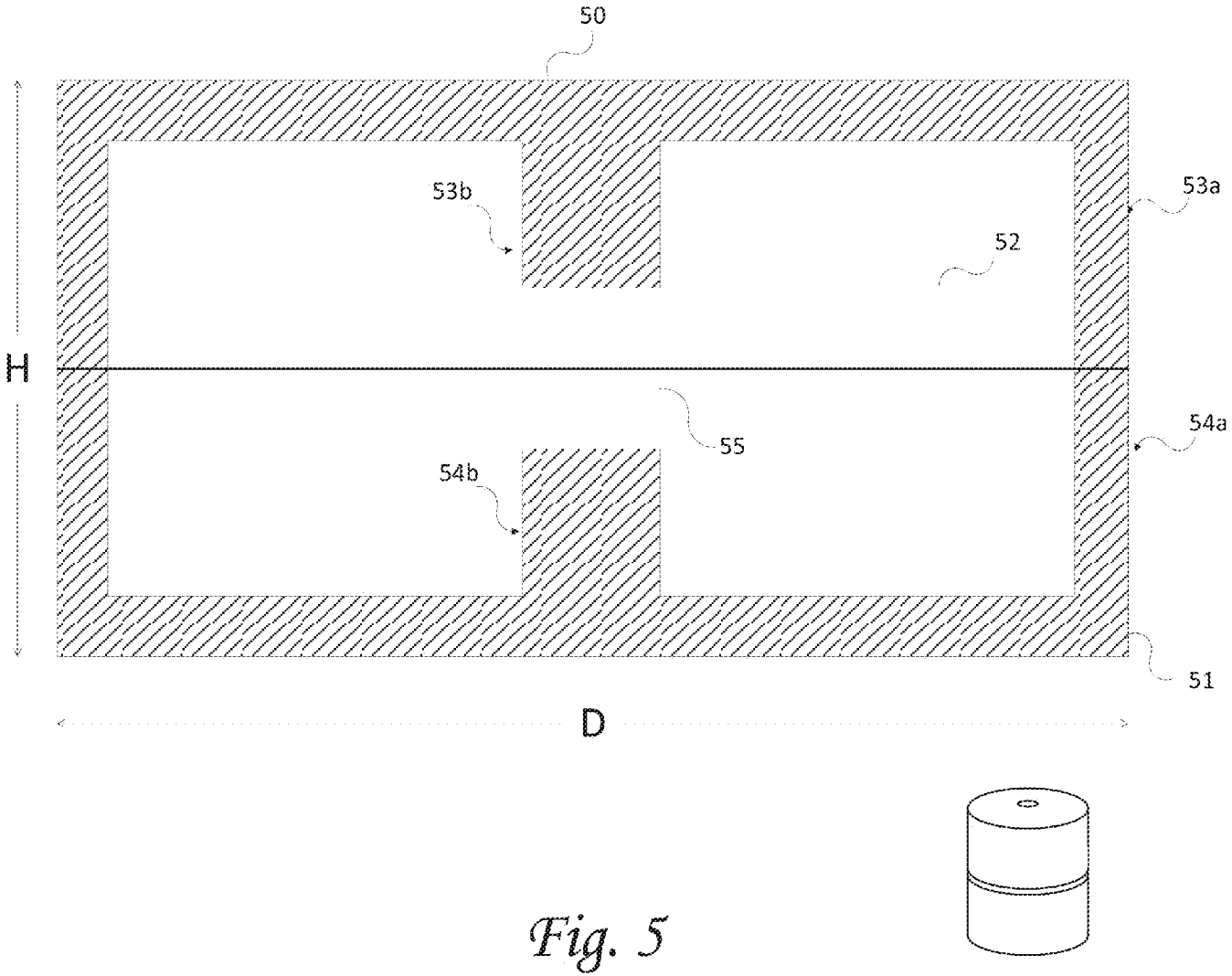
FIG. 5 is a cross-sectional view of a typical pot core structure.

FIG. 5 illustrates a cross sectional view of one embodiment of a pot core structure in accordance with the technology described in U.S. Pat. No. 8,391,514. The inset at the bottom right of the drawing illustrates an external view of the 2 halves shown in the example of FIG. 5.

Two ferrite halves 50, 51 define a cavity 52 within which an inductive device is disposed. Current passing through the inductive device generates a magnetic field, which could interfere with the functionality of the emitter. The ferrite material of the pot core halves 50, 51 serves to contain this magnetic field so that it does not "leak" into the system and cause distortion. Although ferrite is the most common material for pot core structures, the structure may be composed of other materials, such as vitreous metal, carbonyl iron, laminated silicon steel, or any other material capable of shielding magnetic fields. The selection of the pot core material depends on a number of factors, including but not limited to the geometry of the core, the potential size of the air gap, and the permeability of the material chosen.

The two halves 50, 51 each comprise and outer wall 53*a*, 53*b* which substantially encloses the inductive device, and an inner wall 53*b*, 54*b*. An air gap 55 between the inner walls 53*b*, 54*b* increases the permeability of the pot core: the larger the air gap 55, the greater the permeability. The number of windings of the inductive device (wound about the core formed by inner walls 53*b*, 54*b*) required to maintain the same inductance, however, increases with the size of the air gap 55. At the same time, this greater number of windings increases the impedance of the system. Therefore, by adjusting the air gap 55 in the pot core, one can maintain the same inductance to achieve electrical resonance with the emitter while simultaneously increasing the load seen by the amplifier, i.e. increasing the impedance of the system.

FIG. 2 illustrates one embodiment of a transducer system disclosed in U.S. Pat. No. 8,391,514 and applicable for use with an embodiment of the present invention. Signal processing system outputs 24*a*, 24*b* are coupled to an amplifier 26*a*. After amplification, the signal is delivered to an inductive device/emitter assembly 32*a*. The emitter 30*a* is operable at ultrasonic levels. The inductive device 28*a* is coupled in parallel with the emitter 30*a*. The inductive device 28*a* in this embodiment is an inductor element held within a pot core.

Figure 3:
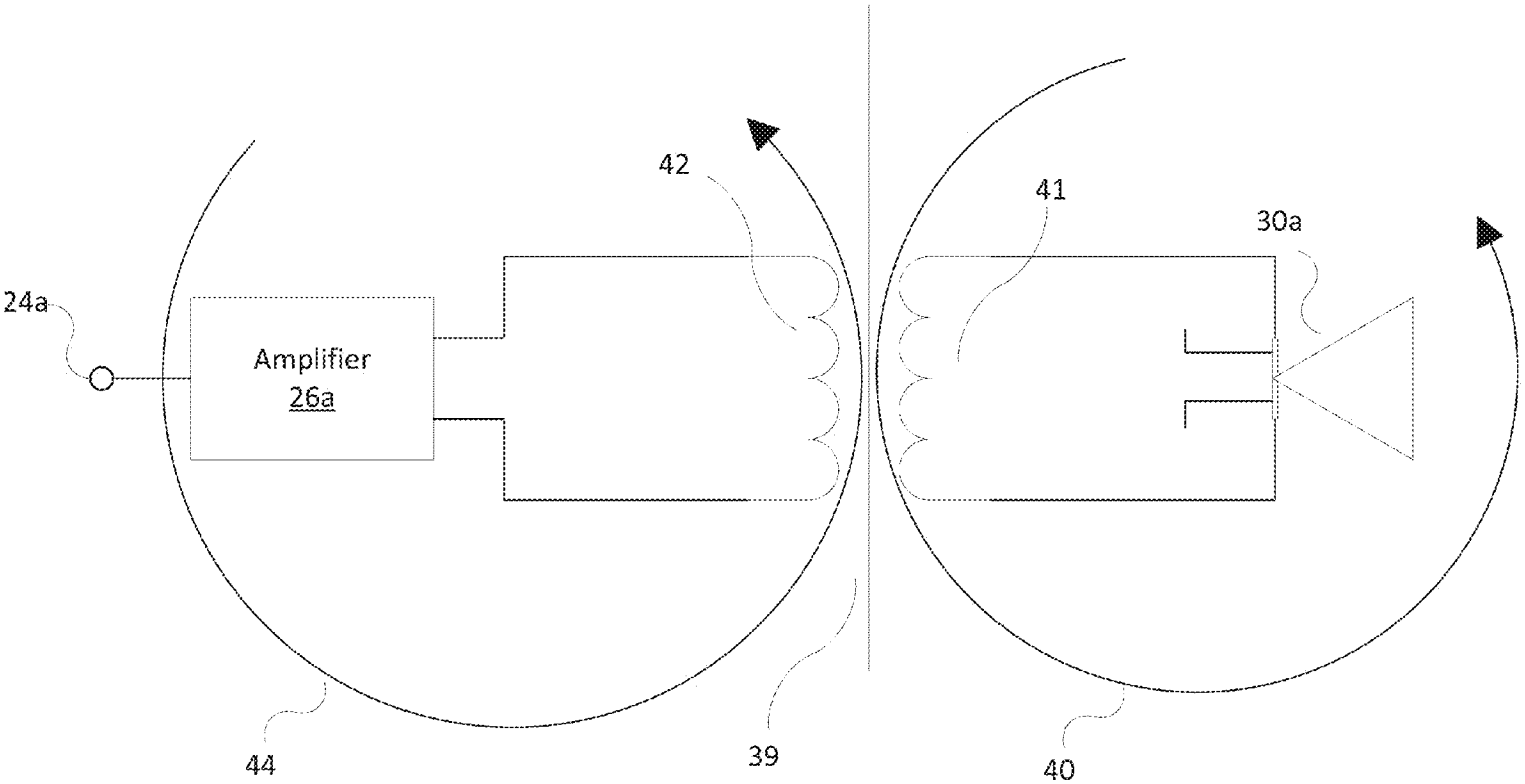
FIG. 3 is a diagram illustrating an amplifier and transducer system utilizing a pot core inductive device in accordance with an embodiment of the technology disclosed herein.

FIG. 3 illustrates another embodiment of a transducer system disclosed in U.S. Pat. No. 8,391,514, wherein a transformer configuration is employed. The transformer 39 comprises a pair of inductor elements. The inductor element, or winding, 42 serves as the primary winding of the transformer and is connected to the amplifier 26*a*. The inductor element, or winding, 41 serves as the secondary winding of the transformer and is connected to the emitter 30*a*. As current passes through the primary winding 42 a voltage is induced in the secondary winding 41. In one embodiment, both the primary and secondary windings are contained within the pot core.

Figure 4:
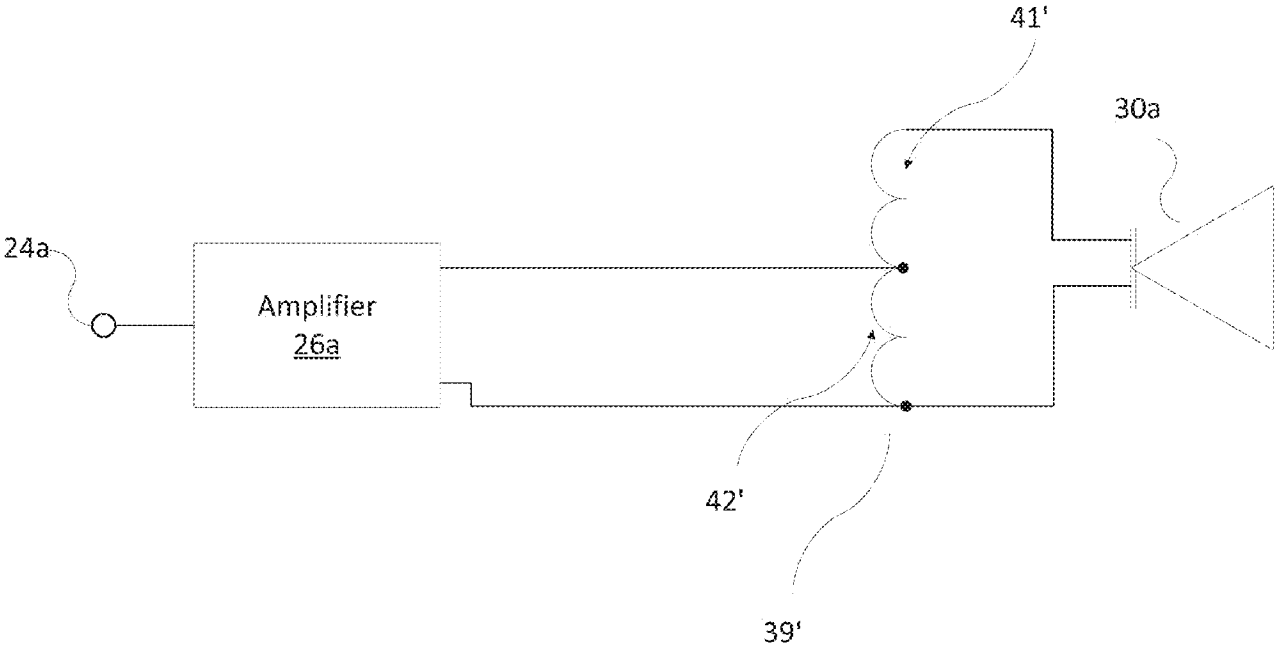
FIG. 4 is a diagram illustrating an amplifier and transducer system utilizing a pot core inductive device in accordance with an embodiment of the technology disclosed herein.

FIG. 4 illustrates another embodiment, wherein the primary and secondary windings are combined in what is commonly known as an autotransformer 39', showing the secondary winding 41' and the primary winding 42' contained in a single winding. The operation and function of an autotransformer will be readily appreciated by one of ordinary skill in the art having possession of this disclosure. The autotransformer can be configured such that its windings can easily be contained within the pot core.

The use of a step-up transformer provides additional advantages to the present system. Because the transformer "steps-up" from the direction of the amplifier to the emitter, it necessarily "steps-down" from the direction of the emitter to the amplifier. The step-down process, minimizing the effect of any such event on the amplifier and the system in general, therefore reduces any negative feedback that might otherwise travel from the inductor and emitter pair to the amplifier.

The characteristics and dimensions of the pot core structure and inductive device utilized in U.S. Pat. No. 8,391,514 can be determined in accordance with the exemplary method of optimizing a parametric system illustrated in FIG. 6. The method is applicable with the presently disclosed technology, as well. The first step 60 is determining the number of turns in the primary winding required to obtain the impedance load that is best for optimal amplifier performance. Once the number of windings required is known, the pot core structure may be designed to take advantage of the size of the air gap, as discussed above. For embodiments of the present invention that are configured to act as an inductor only—and, therefore, have only one winding—the first step 60 is not applicable and, instead, one would start on the second step 62. The second step 62 is to select the number of turns required in the secondary winding required to achieve electrical resonance between the secondary winding and the emitter. The third step 64 is to determine the optimal physical size of the pot core to contain the inductive device. The form factor of the entire parametric audio system will influence the size limitations of the device. The fourth step 66 is to select a size of the air gap 55 between the inner walls 54*a*, 54*b* required to decrease the overall physical size of the pot core while avoiding saturation of the inductive device during operation of the emitter, and to fine tune the inductive device.

In the typical pot core structure utilized in embodiments of U.S. Pat. No. 8,391,514, the determination of the fourth step 66 cannot be changed once the pot core structure has been manufactured. As a result, any distortion of the resultant signal caused by imperfections in the transducer circuit or unforeseen artifacts from miscalculation of the required number of turns cannot be addressed without re-manufacturing the structure. The presently disclosed technology improves upon the typical pot core structure, allowing for adjustments in the size of the air gap 55 in the pot core structure to compensate for these types of distortions. This adjustment allows for additional tuning of the audio system to achieve the optimal sound, with reduced distortion caused by the intense levels at which ultrasonic emitters are operated.

Figure 7:
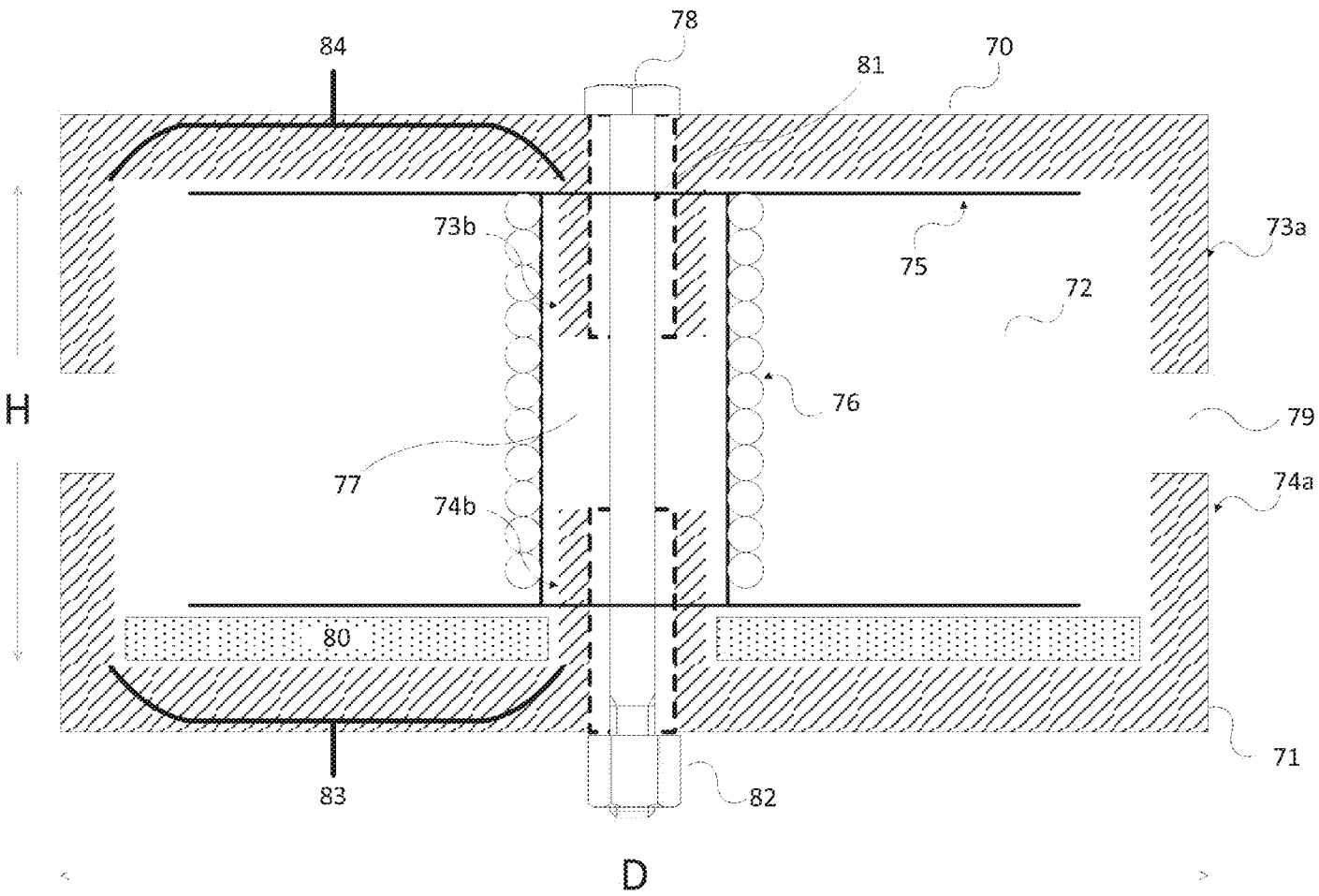
FIG. 7 is a cross-sectional view of a pot core inductive device in accordance with an embodiment of the technology disclosed herein.
Figure 8:
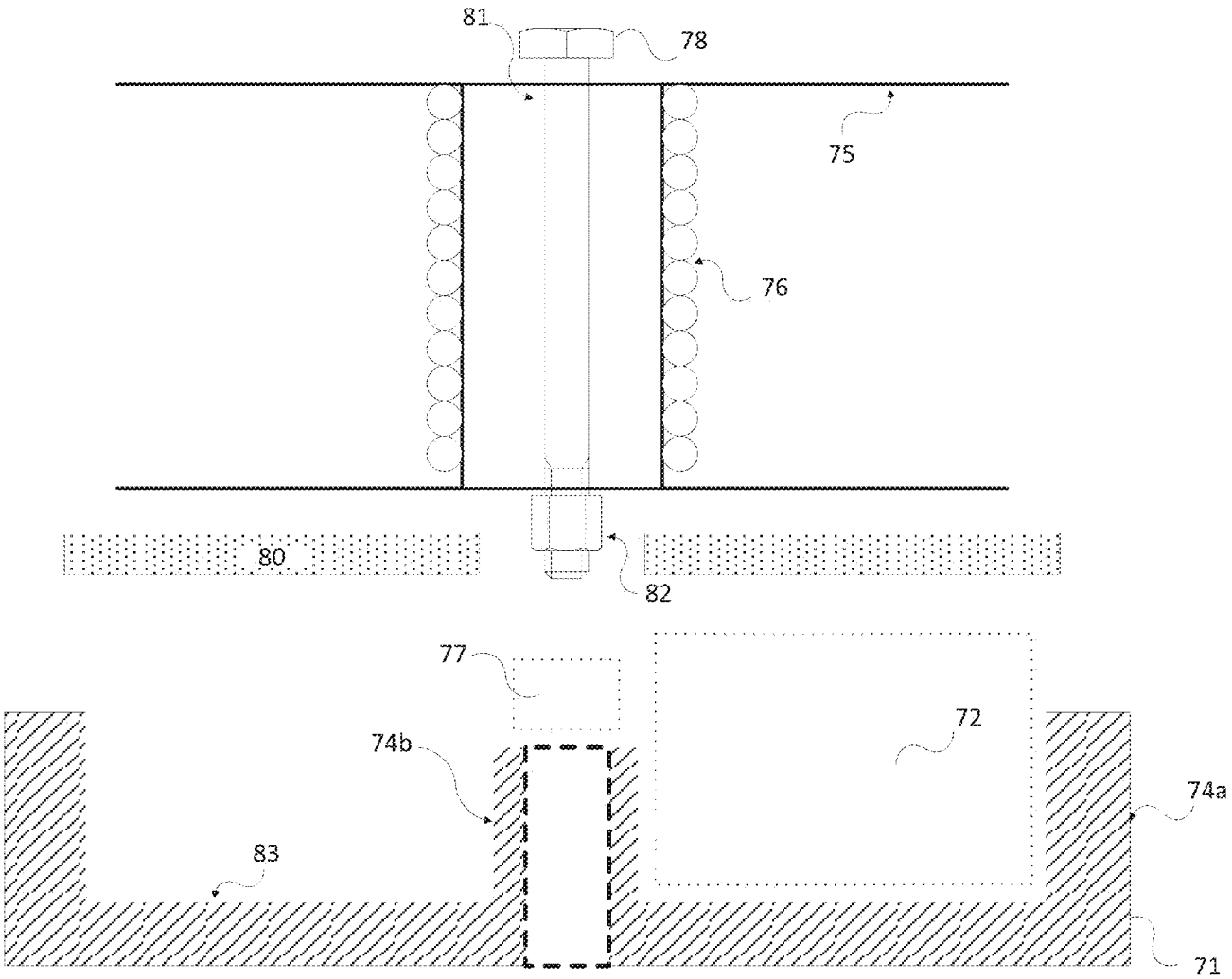
FIG. 8 is a diagram illustrating an exploded view of a pot core inductive device in accordance with an embodiment of the technology disclosed herein.

In various embodiments, the pot core inductive device includes an adjustment mechanism that allows adjustment of the air gap. FIG. 7 is a cross-sectional view of an example embodiment providing such adjustability. FIG. 8 is a diagram illustrating an exploded view of a pot core inductive device such as that shown in FIG. 7. Like the typical pot core structure, the structure in this embodiment comprises two halves 70, 71 that define a cavity 72. Although ferrite is the most common material for pot core structures, use of other suitable materials is possible, as discussed above. Each half 70, 71 comprises an outer wall 73*a*, 74*a* and an inner wall 73*b*, 74*b*. Disposed inside the cavity 72 is a coil support structure 75. A coil structure, or inductor element, 76 is wound around the coil support structure 75. This coil structure 76 can be configured as an inductor, transformer, or autotransformer. The type of coil structure 76 utilized will depend on the type of inductive device is optimal for the user, depending on desired performance, cost of construction, and level of quality of the resultant audio signal. The air gap 77 is formed in the void between the inner walls 73*b*, 74*b* of the two halves 70, 71.

Figure 9:
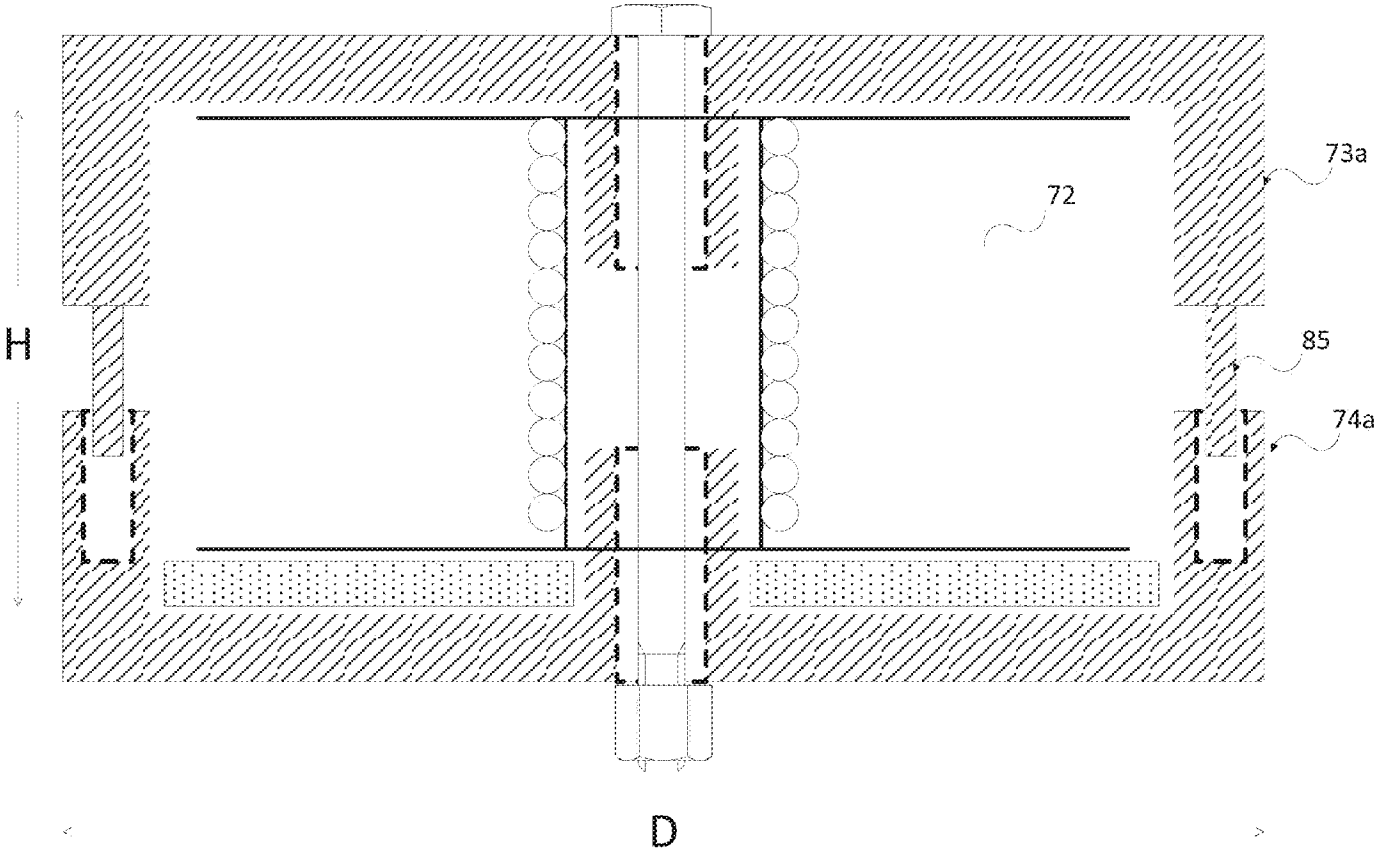
FIG. 9 is a diagram illustrating a pot core structure in accordance with an embodiment of the technology disclosed herein.

In various embodiments, an adjustment mechanism 78 is provided to adjust the positions of halves 70, 71 relative to one another. For example, the adjustment mechanism can be provided to allow adjustment or setting of the spacing between halves 70, 71. In other words, the adjustment mechanism can be used to adjust the volume of cavity 72 and the air gap 77 formed between inner walls 73*b*, 74*b*. In some embodiments, an additional air gap 79 may be formed between outer walls 73*a*, 74*a*, which may also be adjusted by the adjustment mechanism 78. In other embodiments, the two halves 70, 71 may be constructed such that a projection 85 from the outer wall of one half 73*a* slots inside the outer wall of the other half 74*a*, such that the cavity 72 is completely enclosed by the outer walls 73*a*, 74*a*. An example of this is illustrated in FIG. 9.

Adjustment mechanism 78 can comprise any of a number of mechanisms to allow the halves 70, 71 to be adjusted relative to one another. Preferably, the adjustment mechanism 78 also allows the positioning to be maintained over time, for example by using an elastomeric member 80 to maintain pressure against the adjustment mechanism as explained below.

In the example illustrated in FIG. 7, adjustment mechanism 78 can include a male threaded member 81 configured to mate with a female threaded member 82 to adjust the spatial relation of halves 70, 71. Tightening the threaded members 81, 82 would cause halves 70, 71 to move closer together and close the air gap 77, while loosening threaded members 81, 82 would cause halves 70, 71 to move farther apart thereby widening the air gap 77.

In yet another embodiment, the adjustment mechanism 78 can comprise a threaded elongated member (e.g., a bolt or other like configuration) and the inner walls 73*b*, 74*b* can be provided with complementary threads so that female threaded member is not required. The threads presented by half 71 can be threaded in reverse as compared to the threads presented by half 70 such that, turning threaded member 81 causes halves 70, 71 to move in opposite directions to or from one another. In another embodiment, only one half is threaded, and it can be moved along threaded member 81 relative to the other half.

In various embodiments, an adjustable means for securing the two halves may be used. The adjustable means may comprise a clamp attached externally to the two halves 70, 71, or similar structures. Means may also include locking channels disposed on the external sides of the two halves 70, 71 that function to hold the halves 70, 71 together, or similar structures. In some embodiments, the adjustment mechanism 78 and the adjustable means for securing the two halves 70, 71 may be the same component.

The components of the adjustment mechanism can be made from a nonconductive, ferromagnetic material so as not to interfere with the electrical properties of the transductor. For example, the components of the adjustment mechanism can be made from various plastics, polyester, nylon, phenolic, and other nonconductive materials.

In embodiments where the spacing between halves 70, 71 are fixed at a known predetermined dimension, coil support structure 75 can be dimensioned to have a tight fit within the cavity 72. However, where the spatial relation between halves 70, 71 is adjustable (such as, for example, via an adjustment mechanism 78) coil support structure 75 cannot be dimensioned for a tight fit within the cavity 72 throughout the range of adjustment. Accordingly, elastomeric member 80 can be included to provide a snug or tight fit for support structure 75 within cavity 72. Elastomeric member 80 can be provided at a thickness so as to prevent support structure 75 from moving inside the cavity 72.

In various embodiments, elastomeric member 80 can be disposed on a first inner surface 83 of cavity 72 and be configured to expand to apply pressure on coil support structure 75 against the opposite inner surface 84 of cavity 72. In other embodiments, to elastomeric members 80 can be provided, one on each of the top and bottom inner surfaces. For example, as illustrated in FIG. 7, elastomeric member 80 is placed in the bottom of cavity 72, on inner surface 83, and is configured to expand in height, H, to hold coil support structure 75 against the upper inner surface 84 of cavity 72. Elastomeric member 80 is further configured to be compressible in the dimension H such that when the adjustment mechanism 78 is adjusted to bring halves 70, 71 closer together, elastomeric member 80 compresses (decreases in height, H), allowing the height of the cavity 72 to be decreased. Conversely, when the adjustment mechanism 78 is adjusted to increase the separation between halves 70, 71, elastomeric member 80 can expand in height, H, maintaining a tight fit of coil support structure 75 within cavity 72. In other embodiments, one or more elastomeric members 80 may be positioned in the top or bottom of cavity 72. Still further embodiments could employ more than one elastomeric member 80, with at least one disposed in each of the bottom and top of cavity 72. The elastomeric member(s) 80 may be secured in place using a glue, epoxy, tape, or other nonconductive adhesives or fixation mechanisms. In other embodiments, the elastomeric member 80 could be designed as a removable element to allow repair or replacement of the elastomeric member 80, or to allow a selectable number of members 80 to be utilized.

In further embodiments, elastomeric member 80 can be configured to provide sufficient expansive force to cause halves 70, 71 to exert pressure against the adjustment mechanism 78 to maintain spatial relation there between as set by the adjustment mechanism 78. In this respect, elastomeric member 80 can be configured to act like a spring applying an outward pressure against halves 70, 71 against the adjustment mechanism 78. Elastomeric member 80 can be ring- or donut-shaped to conform to the inner dimensions of half 70 (or 71) on the lower surface of cavity 72. Elastomeric member 80 can be made using open- or closed-cell foams or other elastomeric materials having a spring-like property. Preferably, elastomeric member 80 is made of a nonconductive material so as to not interfere with the electrical characteristics of the inductive device.

As the above-described example embodiments illustrate, the pot core inductive device may include an adjustment mechanism, which can be configured to allow the air gap 77 to be increased or decreased to tune its inductance and achieve resonance with the emitter.

Employing the pot core inductive device in place of a typical pot core structure allows tuning of the amplifier and emitter system. This can be particularly useful, for example, in situations where other components of the audio system might not be tightly controlled. For example, the coil structure 76 within support structure 75 may come from the manufacturer or supplier to varying degrees of tolerance. In situations where the air gap 77 and the relation between halves 70, 71 is fixed, variations in the coil structure 76 from one device to the next will result in variations in the inductance value from one device to the next. This, in turn, can impact the ability of these devices to create a resonant circuit with the emitter. Accordingly, providing an adjustable inductive device, with an adjustment mechanism 78 allows the inductance value to be brought to specification to account for variations in the coil structure 76.

Figure 6:
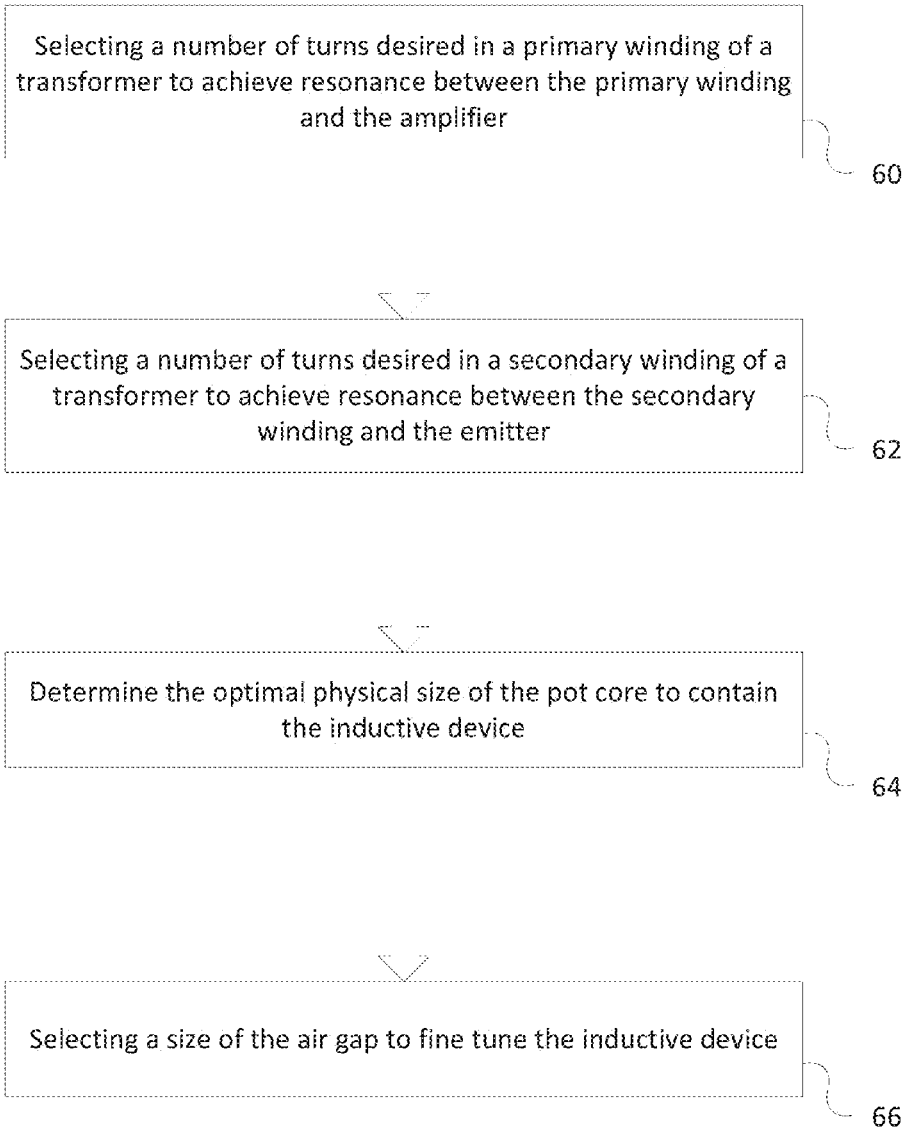
FIG. 6 is a flow diagram illustrating a method of optimizing a parametric transducer system in accordance with an embodiment of the technology disclosed herein.

After selecting the pot core in accordance with the method illustrated in FIG. 6, dynamic adjustments are possible by changing the air gap 77 in response to distortion in the audio signal. When the air gap 77 needs to be decreased, the adjustment mechanism 78 compresses the elastomeric material 80 to allow the two halves 70, 71 to adjust the size of the air gap 77. When the air gap 77 needs to be increased, the adjustment mechanism 78 is reversed and the elastomeric material 80 decompresses, allowing the two halves 70, 71 to move apart and increase the size of the air gap 77.

In various embodiments, the transductor half 71 and member 82 may be secured such that they do not need to be separately held in place when adjustment mechanism 78 is turned to adjust the spacing. For example, transductor half 71 can be glued, adhered, affixed with screws or other fasteners, or otherwise secured to the printed circuit board on which it is mounted so that it doesn't rotate in response to torque applied to adjustment mechanism 78. Similarly, member 82 could likewise be secured to the printed circuit board. Alternatively, member 82 could be disposed in a complementary recess (not shown) in transductor half 71 to hold member 82 in place when torque is applied to member 78.

Figure 11:
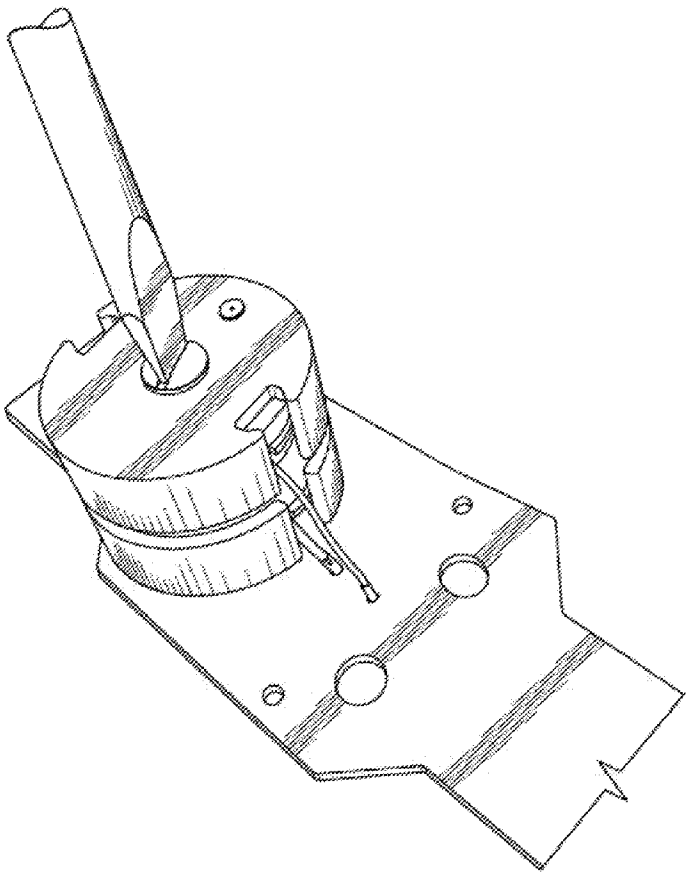
FIG. 11 is a diagram illustrating an assembled pot-core conductor in accordance with one embodiment of the technology disclosed herein.
Figure 10:
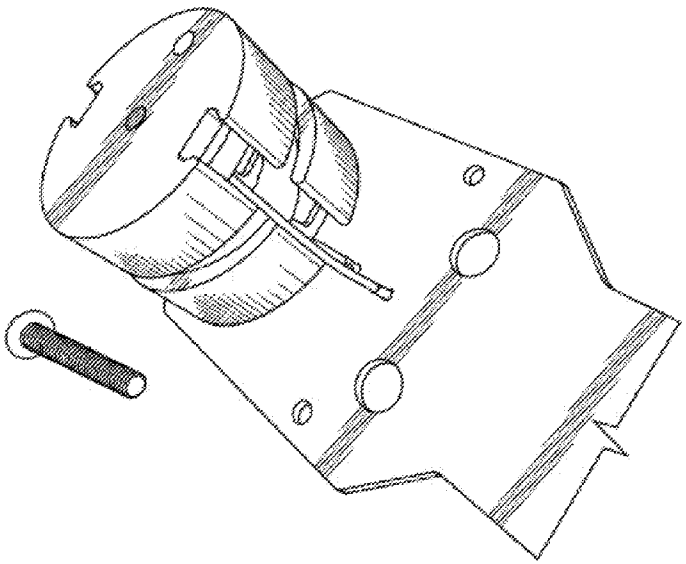
FIG. 10 is a diagram illustrating an assembled pot-core conductor in accordance with one embodiment of the technology disclosed herein.

FIG. 10 is a diagram illustrating a view of an assembled pot core inductor in accordance with one embodiment of the technology disclosed herein. In this diagram, the first and second halves of the ferromagnetic housing are shown as being disposed in an opposing configuration, and partially enclosing the wire windings of an inductive element wound around a support structure or bobbin. The adjustment mechanism, which in this embodiment is a nylon screw, is shown to the left of the assembled pot core structure and is not yet in place. FIG. 11, illustrates a similar pot core structure in accordance with one embodiment, but with a nylon screw in place and being adjusted by the tip of a flat blade screwdriver.

While various embodiments of the present invention have been described above, it should be understood that they have been presented by way of example only, and not of limitation. Likewise, the various diagrams may depict an example configuration for the invention, which is done to aid in understanding the features and functionality that can be included in the invention. The invention is not restricted to the illustrated example configurations, but the desired features can be implemented using a variety of alternative configurations. Indeed, it will be apparent to one of skill in the art how alternative configurations can be implemented to implement the desired features of the present invention.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: adjectives such as "conventional" and "typical" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The invention claimed is:

1. A method of optimizing the output of a parametric audio system, the steps comprising:

coupling a pot core inductive device between an amplifier and an emitter, the pot core inductive device comprising a non-conductive housing comprising a first half and a second half, the first half and the second half having an outer wall, an inner wall, and a base, wherein the two halves are configured to be joined to define a cavity wherein an air gap is formed between the inner wall of the first half and the inner wall of the second half; a coil support member disposed within the housing; a coil structure disposed on the coil support member; an elastomeric material disposed in the cavity defined by the two halves of the housing configured to apply opposing pressure to the first and second halves; and an adjustment mechanism configured to permit a user to manually adjust the air gap to tune the inductive device to a determined inductive value; and manually tuning the inductance of the pot core inductive device by adjusting the pot core inductive device using the adjustment mechanism to achieve resonance of a circuit formed with the inductive device and the emitter.

2. The method of claim 1, wherein the coil structure is a conductive wire configured to act as an inductor.

3. The method of claim 2, wherein the coil structure is configured to act as an autotransformer.

4. The method of claim 1, wherein the coil structure comprises a primary inductor element and a secondary inductor element configured as a transformer.

5. The method of claim 1, wherein the adjustment mechanism is configured to adjust the position of the first half relative to the second half to thereby adjust the air gap to achieve the determined inductive value.

6. The method of claim 5, wherein the determined inductive value is a value chosen to match the resonant frequency of the amplifier to the resonant frequency of an ultrasonic emitter.

7. The method of claim 5, wherein the adjustment mechanism is further configured to secure the first half of the housing to the second half of the housing.

8. The method of claim 1, wherein the adjustment mechanism is configured to apply a first pressure to the first and second halves of the housing, and the elastomeric material is configured to apply a second pressure opposing the first pressure.

9. The method of claim 1, wherein the adjustment mechanism is further configured to secure the first half of the housing to the second half of the housing.

10. The method of claim 1, wherein the elastomeric material is disposed on the base of at least one of the two halves of the housing.

11. The method of claim 1, wherein the elastomeric material is closed-cell or open-cell foam material, or a viscoelastic material.

12. The method of claim 1, wherein the elastomeric material comprises a first elastomeric member disposed on the base of the first half of the housing, and a second elastomeric member disposed on the base of the second half of the housing.

13. The method of claim 1, wherein the elastomeric material secures the coil support member within the cavity.

14. The method of claim 1, wherein the elastomeric material applies pressure against the two halves of the housing to maintain the air gap set by adjusting the pot core inductive device.

15. The method of claim 1, wherein the pot core inductive device is coupled in parallel with the emitter.

16. The method of claim 1, further comprising securing one of the first and second halves of the pot core inductive device to a printed circuit board so that the secured half does not rotate in response to rotation of the adjustment mechanism.

* * * * *